US006428423B1

(12) United States Patent
Merko

(10) Patent No.: US 6,428,423 B1
(45) Date of Patent: Aug. 6, 2002

(54) GOLF CLUB PUTTER HEAD

(75) Inventor: Andy V. Merko, Altadena, CA (US)

(73) Assignee: Andy Merko, Altadena, CA (US)

( * ) Notice: Subject to any disclaimer, the term of this patent is extended or adjusted under 35 U.S.C. 154(b) by 40 days.

(21) Appl. No.: 09/790,402

(22) Filed: Feb. 21, 2001

Related U.S. Application Data

(60) Provisional application No. 60/185,634, filed on Feb. 29, 2000.

(51) Int. Cl.[7] ..... A63B 53/02; A63B 53/04; A63B 53/06

(52) U.S. Cl. ..... 473/307; 473/313; 473/332; 473/341; 473/337

(58) Field of Search ..... 473/334, 335, 473/336, 337, 338, 339, 332, 329, 340, 341, 288, 245, 246, 247, 248, 251, 305–315, 409, 324

(56) References Cited

U.S. PATENT DOCUMENTS 2,155,830 A * 4/1939 Howard
3,516,674 A * 6/1970 Scarborough
4,121,832 A 10/1978 Ebbing
4,343,472 A * 8/1982 Hamilton
5,390,919 A * 2/1995 Stubbs
5,407,196 A * 4/1995 Busnardo
5,429,356 A * 7/1995 Dingle
5,533,730 A * 7/1996 Ruvang
5,542,665 A * 8/1996 Levocz
5,803,825 A * 9/1998 Hamilton
5,863,257 A * 1/1999 Busnardo
5,899,817 A * 5/1999 Dunikoski
5,910,055 A * 6/1999 Bennett
6,019,686 A * 2/2000 Gray

* cited by examiner

*Primary Examiner*—Sebastiano Passaniti
(74) *Attorney, Agent, or Firm*—Norton Townsley

(57) ABSTRACT

A modular-design putter head, having an extruded main body with detachable, heat treated face and hosel bracket. A unique floating-face feature impart trampoline effect when a ball is struck. A flexible hosel, fastened at two points at the rear of the main body acts as a spring for softer touch. Acoustical properties are enhanced with an internal echo chamber which can be filled with foam. A further departure of the traditional putter design and method of manufacture involve the use of extruded metal to form the main putter head. The extruded stock can be cut to desired lengths allowing for economical production of different weight putter heads.

17 Claims, 4 Drawing Sheets

GOLF CLUB PUTTER HEAD

CROSS REFERENCE

The Applicant claims the benefit of his Provisional Application, serial No. 60/185,634 (filed Feb. 29, 2000).

BACKGROUND OF THE INVENTION

1. Field of the Invention

The present invention relates to golf club head and more specifically to a putter head employing an extruded body, detachable hosel and face, extended heel and toe weighting, and provision for mounting additional counterweights.

2. Background of the Invention

Golf club heads are traditionally made by investment or sand casting. Afterwards they are ground, polished, and detailed to a desired finish. Alternately, the entire club head is machined from a solid block of metal.

While the above mentioned methods produce an acceptable club head, there are several disadvantages in both methods. The cast club head involves the making of a master model club head from which a mold is made. The mold is filled with wax, producing a replica wax head which is then removed from the mold. The wax head is then dipped into a binder solution and covered with fine sand. Several dipping and coating cycles are required to build a ceramic "cocoon" to form a shell of sufficient thickness to accept poured metal. This built-up takes several days; it is labor intensive and has fairly high rejection rate.

Finally, the wax is heated and poured out of the shell, leaving a cavity to be filled with molten metal. When the metal has cooled, the shell is broken off and the resulting metal head goes through several stages of grinding and polishing operations before it is ready for shafting.

The so-called milled head is milled out of solid block of metal making it the most expensive way to fabricate a putter head—most of the steel is wasted in the manufacturing process. This type of putter head is typically gun-metal blued or plated.

The desirable properties for putter are basically sound and feel. While these qualities are highly subjective, most golfers prefer a putter to have a soft touch and feature parameter weighting which reduces the club head twist if the ball is struck slightly off-center. The development of a putter which addresses these concerns and incorporates the desirable qualities listed above, represents a significant improvement in the manufacturing process and playability of the putter.

SUMMARY OF THE INVENTION

The present invention represents an improvement in the field of golf club head design. The modular design of the putter incorporates a main body made of extruded material, preferably aluminum, which determines the general shape of the putter head. The striking face and the hosel can be made of different alloys or synthetics. Accordingly, the objects and advantages of this invention are: To eliminate the traditional casting or excessive milling operations by constructing the main club head of extruded aluminum or various plastics, which can be cut to suitable thicknesses, to achieve desirable weight ranges. To improve the balance of the putter head by maximum heel and toe weighting. This feature makes the putter head less prone to twisting when the ball is stuck off-center. Additional weights can be attached behind the hosel bracket using the same mounting screws. Without departing from the basic design, the putter can be made left or right handed by simply reversing the ninety degree bend of the hosel bracket

DESCRIPTION OF PREFERRED EMBODIMENT

Figure 1:
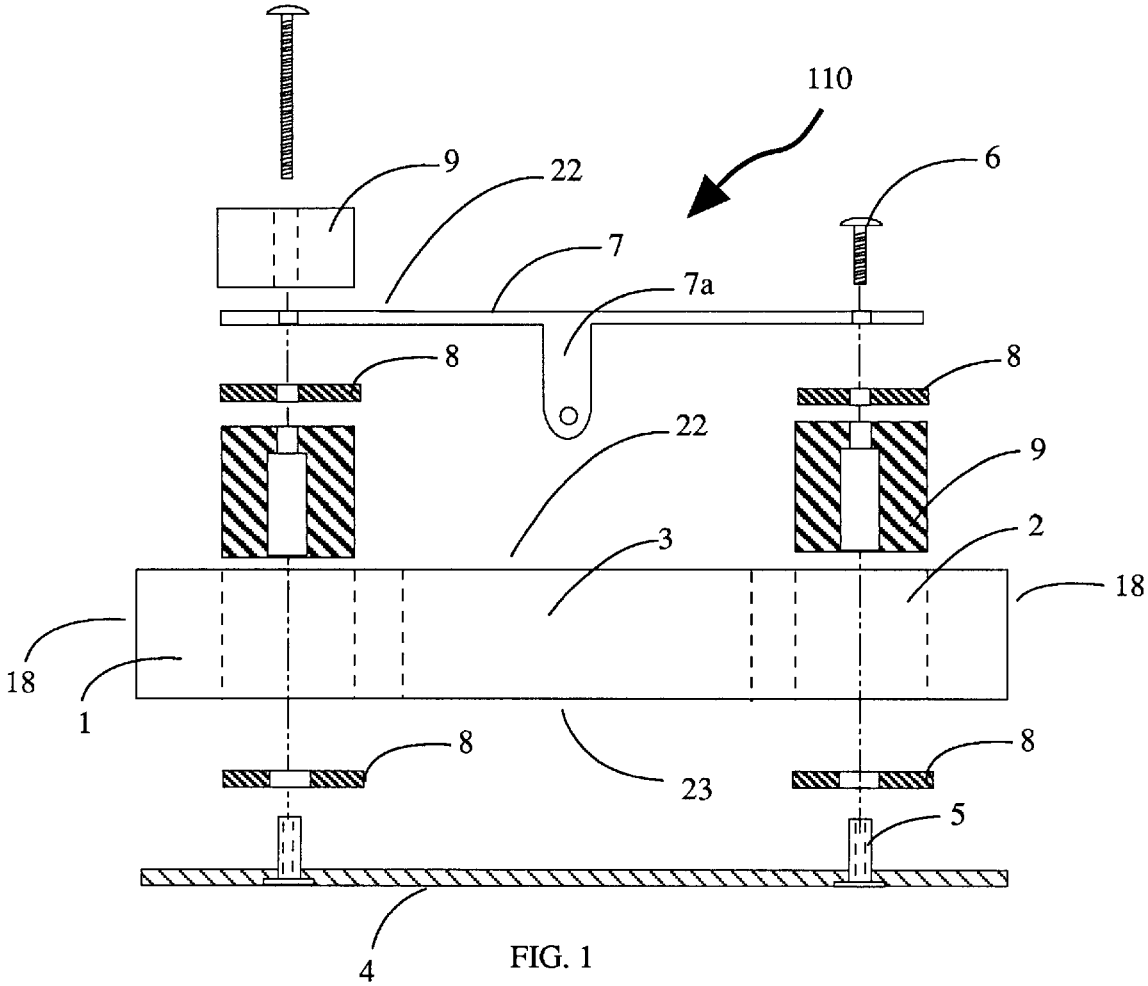
FIG. 1 Is an isometric exploded top view of a putter 110.

FIG. 1 Shows an isometric, exploded, top-view of a putter 110 with its components: the main body 1; the weight cavities 2; the echo chamber 3; the face 4; threaded standoffs 5; fasteners 6; a hosel bracket 7; upward facing surface 7*a*; washers 8; rear 22 of hosel bracket 7 and main body 1; front 23 of main body 1; ends 18 of the main body 1; and weights 9.

Figure 2:
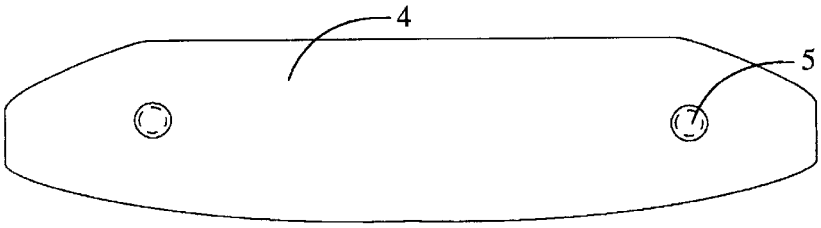
FIG. 2 Is a front view of a putter face 4.

FIG. 2 Is a front view of the face 4 with the two standoffs 5, pressed into position.

Figure 3:
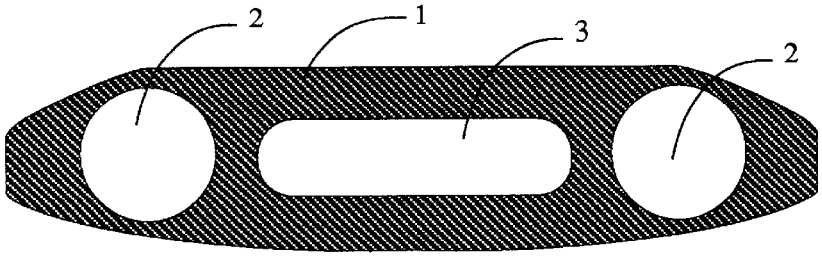
FIG. 3 Is a front view of an extruded section of the main body 1

FIG. 3 Is a front cut-off view of the main body 1 with the weight cavities 2; and the echo chamber 3.

Figure 3A:
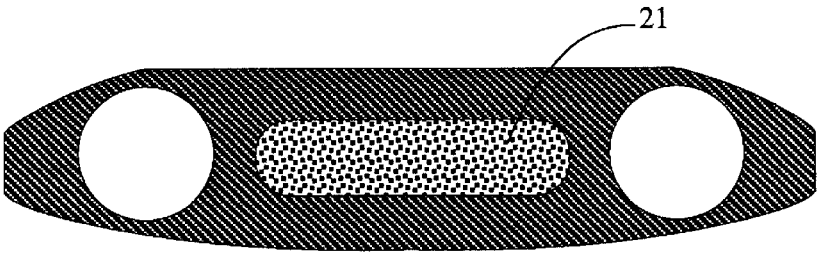
FIG. 3A Shows the echo chamber filled with foam 21

FIG. 3A Shows the echo chamber 3 filled with foam 21.

Figure 4A:
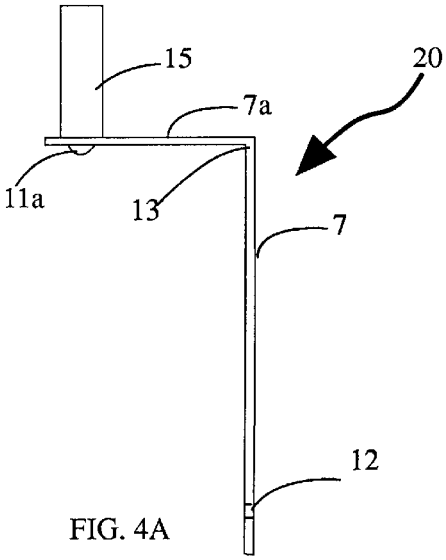
FIG. 4A Is a rear view of a complete hosel 20
Figure 4:
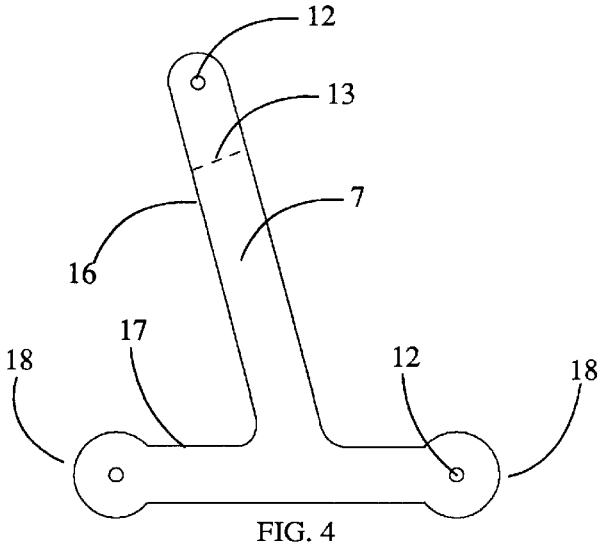
FIG. 4 Is a side view of a hosel bracket 7

FIG. 4 Shows the hosel bracket 7, indicated 90 degree bend 13; upright leg 16; cross leg 17; ends 18.

FIG. 4A Shows hosel 20 with shaft socket 15; 90 degree bend 13; hole 12; hosel bracket 7; upward facing surface 7*a*; and knurled compressed stub 11*a*.

Figure 5:
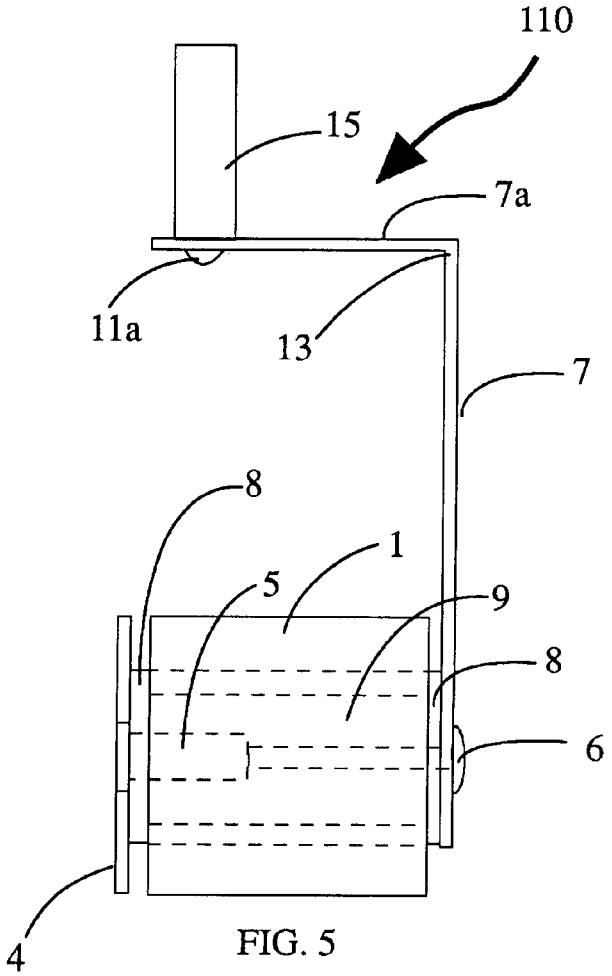
FIG. 5 Is a rear view of the putter 110

FIG. 5 Is a rear view of the putter 110; with the hosel bracket 7 attached with the fasteners 6 through the washers 8, through the main body 1 and the weights 9, and fastened to the standoffs 5, attached to the face 4. The hosel bracket 7 is shown with the 90-degree bend 13. A shaft-socket 15 is shown pressed onto the hosel bracket 7. The knurled stub 11 is then mechanically flattened to form stub 11*a* to prevent rotation.

Figure 6:
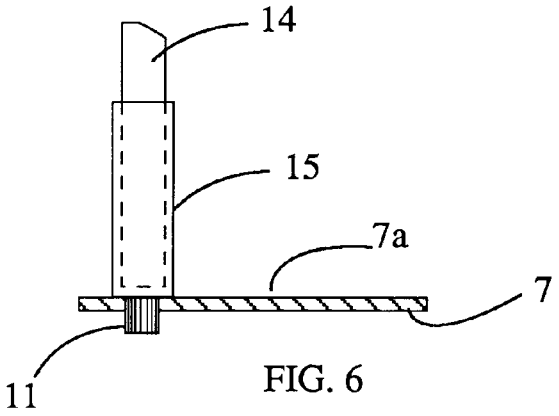
FIG. 6 Is a cut off rear view of a hosel bracket 7 and shaft socket 15

FIG. 6 Shows a shaft-socket 15 featuring a knurled stub 11 which is press-fitted into the hosel bracket 7. The knurled stub 11 prevents the shaft-socket 15 from rotating. After the stub 11 is pressed into the hole 12, it is mechanically compressed to form a knurled compressed stub 11*a* for additional strength. See FIG.

Figure 7:
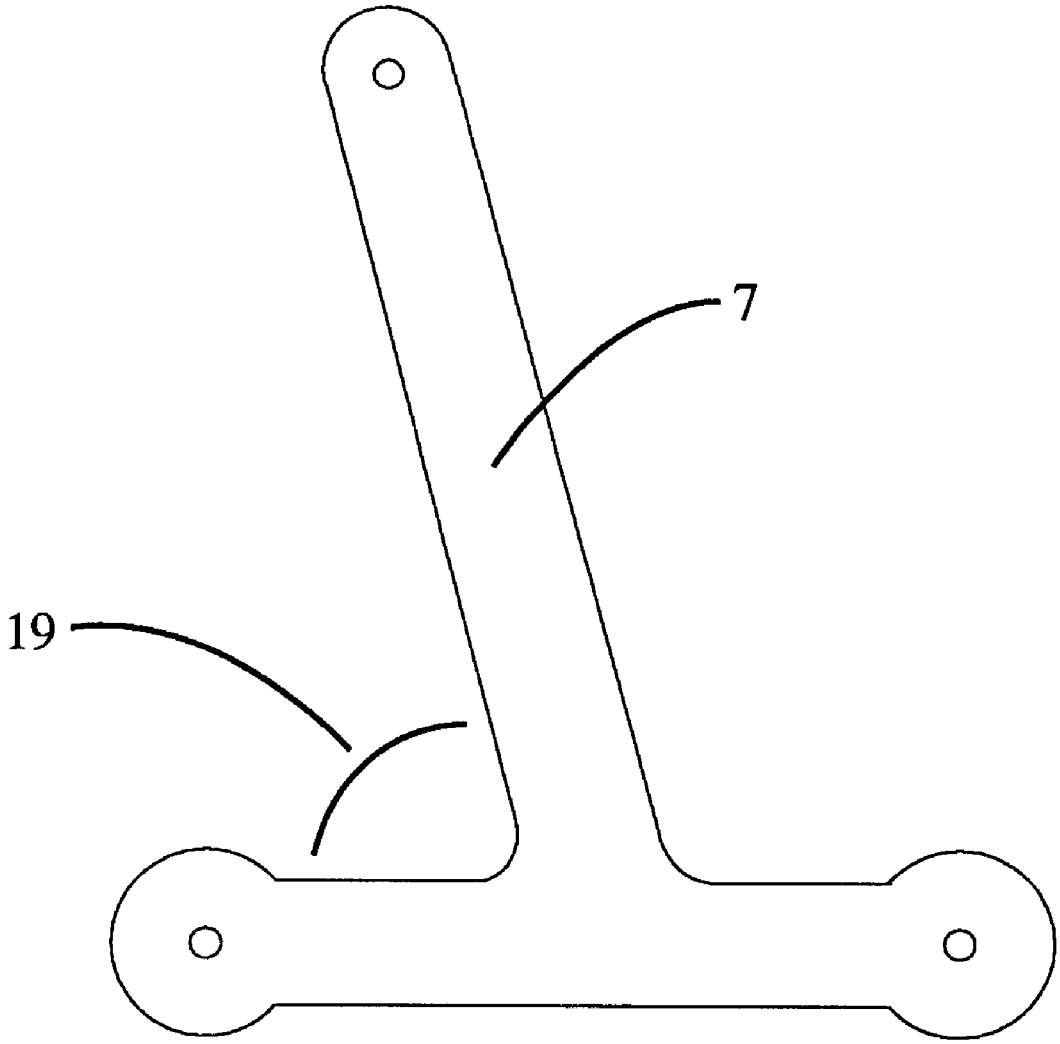
FIG. 7 Shows the hosel bracket 7 and the relative angle 19

FIG. 7 Is a side view of hosel bracket 7. This shape is preferably stamped from metal. Note the relative angle 19 which is less than 90 degrees.

The preferred method of making the putter head 110 is first to fabricate the hosel bracket 7. The preferred material is steel and the preferred method of fabrication is stamping. As can be seen from FIG. 4, the hosel bracket 7 is essentially T shaped. It has an upright leg 16 and cross leg 17, and three attachment holes 12 close to the ends 18 of the legs 17. The angle 19 between the upright and cross legs is slightly less than 90 degrees—see FIG. 7, also. Next a ninety degree bend 13 is formed in the upright leg 16. This creates an upward facing surface 7*a*. As will be apparent, if the bend 13 is formed one way, a right hand bracket will be formed. See FIG. 5. If the bend is formed the opposite way, a left-hand bracket will be formed.

Next a shaft socket 15 is attached to the attachment hole 12 in the upward facing surface 7*a*. The preferred method of attachment is by knurled stub 11 as described above and illustrated in FIG. 6. However, other methods of attachment, for example welding or soldering will clearly work. The subassembly of the hosel bracket 7 with the shaft socket 15 creates a hosel 20. At this point the hosel 20 may be heat treated to desirable flexibility. This hosel 20 is equivalent in function to any other hosel used in the art of making golf clubs. However, this hosel 20 is uniquely flexible, disassemblable at will from the club head and allows attachment to the rear of the club head.

Other components that are needed are a main body 1, face plate 4 and weights 9. The main body I has two transverse weight cavities 2 close to its ends 18 and a transverse echo chamber 3 located approximately in the middle of the main body 1. The main body 1 has the general shape of the putter as illustrated in FIGS. 1 and 3. The face plate 4 has the same shape as the cross section of the main body 1. See FIG. 2. The weights 9 and the weight cavities 2 have matching shapes. Although cylindrical shapes are illustrated on FIGS. 1 and 3 their shapes could be square, hexagonal or any other convenient shape.

Once the hosel 20 is fabricated, and the other components 1, 4, 8, 9, are accumulated, assembly can begin. The weights 9 are slid through the weight cavities 2, the cross leg 17 of hosel bracket 7 is attached to the rears 22 of the weights 9 and the face plate 4 is attached to the fronts 23 of the weights 9. See FIGS. 1 and 5. Additional weights 9 can be attached to the rears 22 of the hosel bracket 7 as shown in FIG. 1.

Once the putter head 110 is assembled, it can be attached to the shaft 14 by conventional means. See FIG. 6.

Different feel and acoustics can be fine-tuned by the selection and heat treatment of the face 4 and hosel bracket 7 or by selecting the material density and thickness of the washers 8, inserted between the face 4 and the main body front 23 or between the hosel bracket 7 and the main body rear 22. While metals such as aluminum and steel arc the preferred materials, it is possible to make the main body 1, the face 4, and the hosel 20 of synthetics such as plastics and carbon fibers.

The echo chamber 3 resonates the sound of the ball being stuck and also serves to reduce the weight from the center of the putter head 110. enabling the weights to be distributed towards the ends 18 of the putter head 110. The echo chamber 3 can be filled with foam 21 to further alter the acoustic properties of the putter head 110.

The procedure of attaching the club face 4 to the hosel bracket 7 can be reversed—the threaded standoffs 5 can be pressed into the hosel bracket 7 first and the fasteners 6 inserted from the face 4 side. Alternately, the center hole 12 in the weights may be threaded and the face 4 and hosel bracket 7 attached directly against the weights 9 with fasteners 6. The putter head 110 has been described with a reference to a particular embodiment However, it should be obvious to those skilled in the art, to which this invention pertains, that other modifications and enhancements can be made without departing from the spirit and scope of the claims that follow.

Reference Numerals In Drawings

110 Putter
1 Main body
2 Weight cavities
3 Echo chamber
4 Face
5 Self-clinching standoffs
6 Fasteners (generic)
7 Hosel bracket
8 Washers
9 Weights
11 Knurled stub
11*a* Knurled stub compressed
12 Hole (generic)
13 Ninety degree bend
14 Shaft
15 shaft-socket
16 Upright leg
17 Cross leg
18 Ends
19 Angle
20 Hosel
21 Foam
22 Rears (generic)
23 Fronts (generic)

What is claimed is:

1. A putter head comprising:

a. a main body; said body having a front and a back, a transverse echo chamber and a transverse weight cavity;

b. a weight inserted through said weight cavity; said weight having the same shape as said weight cavity; said weight having a front and a back;

c. a hosel bracket attached to said back of said weight; said hosel bracket including a 90 degree bend to produce an upwards facing surface;

d. a shaft socket attached to said upward facing surface so as to create a hosel; and e. a distinct face plate attached to said front of said weight.

2. A putter head as claimed in claim 1 in which said echo chamber is filled with foam.

3. A putter head as claimed in claim 1 in which said hosel bracket is attached to said weight and said weight is attached to said face plate with threaded fasteners.

4. A putter head as claimed in claim 1 in which said hosel bracket is attached to said weight and said weight is attached to said face plate with adhesive.

5. A putter head as claimed in claim 1 further comprising washers between said hosel bracket and said weight and between said weight and said face plate.

6. A putter head as claimed in claim 1 in which the flexibility of said hosel bracket is adjusted to a desired value by heat treatment.

7. A putter head as claimed in claim 1 further comprising an additional weight attached to the rear of said hosel bracket.

8. A putter head as claimed in claim 1 further comprising a gasket between said face plate and said main body.

9. A method of fabricating a putter head comprising the steps of:

a. providing a main body; said body having a front and a back, a transverse echo chamber and a transverse weight cavity;

b. providing a weight; said weight having the same shape as said weight cavity; said weight having a front and a back;

c. providing a hosel bracket;

d. forming a 90 degree bend in said hosel bracket to produce an upward facing surface;

e. providing a shaft socket;

f. providing a face plate;

g. attaching said shaft socket to said upwards facing surface to create a hosel;

h. inserting said weight through said weight cavity;

i. attaching said hosel bracket to said back of said weight; and j. attaching said face plate to said front of said weight.

10. A method as claimed in claim 9 further comprising the step of filling said echo chamber with foam.

11. A method as claimed in claim 9 in which said hosel bracket is attached to said weight and said weight is attached to said face plate with threaded fasteners.

12. A method as claimed in claim 9 in which said hosel bracket is attached to said weight and said weight is attached to said face plate with adhesive.

13. A method as claimed in claim 9 further comprising the steps of inserting washers between said hosel bracket and said weight and between said weight and said face plate.

14. A method as claimed in claim 9 further comprising the step of heat treating said hosel bracket to obtain desired flexibility.

15. A method as claimed in claim 9 further comprising the steps of a. providing an additional weight; and b. attaching said additional weight to the rear of said hosel bracket.

16. A method as claimed in claim 9 further comprising the steps of heat treating said face plate.

17. A method as claimed in claim 9 further comprising the steps of:

a. providing a gasket having a shape essentially the same as said face plate b. interposing said gasket between said main body and said face plate.

* * * * *